US009683751B2

(12) United States Patent
Inada et al.

(10) Patent No.: US 9,683,751 B2
(45) Date of Patent: Jun. 20, 2017

(54) OUTDOOR UNIT FOR MULTI-TYPE AIR CONDITIONER

(71) Applicant: Toshiba Carrier Corporation, Kawasaki-Shi, Kanagawa (JP)

(72) Inventors: Yuji Inada, Fuji (JP); Yukio Kiguchi, Fuji (JP); Kiyotaka Ueno, Fuji (JP)

(73) Assignee: TOSHIBA CARRIER CORPORATION, Kawasaki-Shi (JP)

( * ) Notice: Subject to any disclaimer, the term of this patent is extended or adjusted under 35 U.S.C. 154(b) by 124 days.

(21) Appl. No.: 14/428,849

(22) PCT Filed: Sep. 20, 2013

(86) PCT No.: PCT/JP2013/075458

§ 371 (c)(1),
(2) Date: Mar. 17, 2015

(87) PCT Pub. No.: WO2014/046236

PCT Pub. Date: Mar. 27, 2014

(65) Prior Publication Data

US 2015/0267925 A1 Sep. 24, 2015

(30) Foreign Application Priority Data

Sep. 21, 2012 (JP) ..... 2012-207706

(51) Int. Cl.
*F24F 1/08* (2011.01)
*F25B 13/00* (2006.01)
(Continued)

(52) U.S. Cl.
CPC ..... *F24F 1/08* (2013.01); *F24F 1/32* (2013.01); *F25B 13/00* (2013.01); *F25B 41/04* (2013.01);
(Continued)

(58) Field of Classification Search
CPC ..... F24F 1/02; F24F 1/26; F24F 1/30; F24F 3/065; F24F 1/28–1/32; F25B 13/00
See application file for complete search history.

(56) References Cited

U.S. PATENT DOCUMENTS

2006/0162353 A1* 7/2006 Ha ..... F25B 13/00 62/149
2010/0146998 A1* 6/2010 Tomioka ..... F25B 13/00 62/228.3
2012/0304685 A1 12/2012 Kiguchi

FOREIGN PATENT DOCUMENTS

EP 1610070 12/2005
JP S55-121169 U 8/1980
(Continued)

OTHER PUBLICATIONS

International Search Report issued in PCT/JP2013/075458 on Dec. 24, 2013.
(Continued)

*Primary Examiner* — Jianying Atkisson
*Assistant Examiner* — Antonio R Febles
(74) *Attorney, Agent, or Firm* — DLA Piper LLP US

(57) ABSTRACT

An outdoor unit for a multi-type air conditioner includes a compressor, a four-way valve, an outdoor heat exchanger, an outdoor expansion valve, a liquid tank, an accumulator, a shutoff valve provided for the refrigerant pipe between a liquid refrigerant inlet/outlet port and the liquid tank in the outdoor unit, and a first bypass circuit provided in the refrigerant pipe for bypassing the shutoff valve through a capillary tube to connect a liquid refrigerant inlet/outlet port side to an upper side of the refrigerant pipe in a gravity direction. The outdoor unit further includes a second bypass circuit for connecting a bottom portion of the liquid tank to an inlet side of the accumulator via an electromagnetic valve.

2 Claims, 3 Drawing Sheets

(51) Int. Cl.

| | |
|---|---|
| ***F25B 41/04*** | (2006.01) |
| ***F25B 41/06*** | (2006.01) |
| ***F24F 1/32*** | (2011.01) |

(52) U.S. Cl.

CPC ..... *F25B 41/067* (2013.01); *F25B 2313/005* (2013.01); *F25B 2313/023* (2013.01); *F25B 2313/025* (2013.01); *F25B 2313/0252* (2013.01); *F25B 2400/04* (2013.01); *F25B 2400/0411* (2013.01); *F25B 2600/2501* (2013.01)

(56) References Cited

FOREIGN PATENT DOCUMENTS

| | | | | | |
|---|---|---|---|---|---|
| JP | S55-143363 | A | | 11/1980 | |
| JP | H02-126044 | A | | 5/1990 | |
| JP | 08035731 | A | * | 2/1996 | ..... F25B 13/00 |
| JP | 3229648 | B2 | | 11/2001 | |
| JP | 2006090683 | A | * | 4/2006 | ..... F25B 13/00 |
| JP | 2006-220342 | | | 8/2006 | |
| JP | 2009-236397 | A | | 10/2009 | |
| JP | 4575184 | B2 | | 11/2010 | |
| KR | EP 1643196 | A1 | * | 4/2006 | ..... F25B 13/00 |
| WO | WO 2011/099628 | | | 8/2011 | |

OTHER PUBLICATIONS

International Preliminary Report on Patentability issued in PCT/JP2013/075458 on Mar. 24, 2015.

English Language Abstract of JP 4575184 B2 published on Nov. 4, 2010.

English Language Abstract and machine translation of JP 2009-236397 a published on Oct. 15, 2009.

English Language Abstract and machine translation of JP H02-126044 published on May 15, 1990.

English Language Abstract of JP 3229648 B2 published on Nov. 19, 2001.

Extended Search Report issued in EP 13839401.0 on May 30, 2016.

English language Abstract and machine Translation of JP 2006-220342 published Aug. 24, 2006.

* cited by examiner

OUTDOOR UNIT FOR MULTI-TYPE AIR CONDITIONER

CROSS REFERENCE TO RELATED APPLICATIONS

This application is a U.S. National Stage Application of International Application No. PCT/JP2013/075458 filed Sep. 20, 2013, which claims priority from Japanese Patent Application No. 2012/207706 filed Sep. 21, 2012. The entirety of all the above-listed applications are incorporated herein by reference.

TECHNICAL FIELD

The present invention relates to an outdoor unit for a multi-type air conditioner which includes a plurality of indoor units and a plurality of outdoor units.

BACKGROUND ART

In the field of air conditioners, there is known a multi-type air conditioner including a plurality of outdoor units connected in parallel to a plurality of indoor units via refrigerant pipes, respectively.

In this type of air conditioner, the number of outdoor units to be operated is arranged in response to a request of an indoor unit.

However, in a case where an outdoor unit in operation and an outdoor unit during shutdown exist in mixed arrangement, a refrigerant may flow into the outdoor unit during the shutdown from the outdoor unit in operation via a refrigerant pipe, and the refrigerant may stagnate in a liquid tank, which may result in shortage in a circulating amount of refrigerant in a refrigeration cycle.

Accordingly, there is known a configuration in which a shutoff valve is provided between a liquid refrigerant inlet/outlet port and a liquid tank of each outdoor unit, and by fully closing the shutoff valve, the refrigerant is prevented from flowing into the liquid tank of the outdoor unit during the shutdown. There is also known a configuration in which a circulating amount of refrigerant in a refrigeration cycle is adjusted by controlling opening and closing of the shutoff valve.

PRIOR ART DOCUMENT

Patent Document

Patent Document 1: Japanese Patent No. 3229648
Patent Document 2: Japanese Patent No. 4575184

SUMMARY OF THE INVENTION

Problems to be Solved by the Invention

In the conventional configuration, when the shutoff valve is fully closed, it becomes impossible to accumulate a surplus refrigerant in the refrigeration cycle in the liquid tank of the outdoor unit during shutdown. Therefore, the amount of refrigerant circulating in the refrigeration cycle is not adjustable. In the meantime, when the shutoff valve is opened and closed to adjust the amount of refrigerant circulating in the refrigeration cycle, it becomes complicated to control the adjustment, thus being inconvenient and disadvantageous.

In view of the conventional technology mentioned above, an object of the present invention is to provide an outdoor unit for a multi-type air conditioner capable of properly adjusting the amount of refrigerant circulating in a refrigeration cycle by providing a shutoff valve between a liquid refrigerant inlet/outlet port and a liquid tank in the outdoor unit without complicating the control of a shutoff valve for adjusting the refrigerant circulation amount.

Means for Solving the Problems

In order to accomplish the above object, an outdoor unit for a multi-type air conditioner of the present embodiment is an outdoor unit for a multi-type air conditioner including a plurality of indoor units and a plurality of outdoor units which are connected via a refrigerant pipe, and each of the outdoor units includes a compressor, a four-way valve, an outdoor heat exchanger, an outdoor expansion valve, a liquid tank, an accumulator, a shutoff valve provided for the refrigerant pipe between a liquid refrigerant inlet/outlet port and the liquid tank in each of the outdoor units, and a first bypass circuit provided for the refrigerant pipe for bypassing the shutoff valve through a capillary tube to connect a liquid refrigerant inlet/outlet port side to an upper side of the refrigerant pipe in a gravity direction.

It may be preferred that the outdoor unit for a multi-type air conditioner of the present embodiment further includes a following embodiment.

Each of the outdoor units may preferably include a second bypass circuit for connecting a bottom portion of the liquid tank to an inlet side of the accumulator via an electromagnetic valve.

Effects of the Invention

According to the outdoor unit for a multi-type air conditioner in the embodiment of the present invention of the characters described above, the shutoff valve is provided between the liquid refrigerant inlet/outlet port and the liquid tank in the outdoor unit, so that the refrigerant amount circulating a refrigeration cycle can properly be adjusted without complicating the control by the shutoff valve for adjusting the refrigerant circulation amount.

EMBODIMENT FOR CARRYING OUT THE INVENTION

Hereunder, an embodiment of the multi-type air conditioner according to the present invention will be described with reference to the accompanying drawings.

Figure 1:
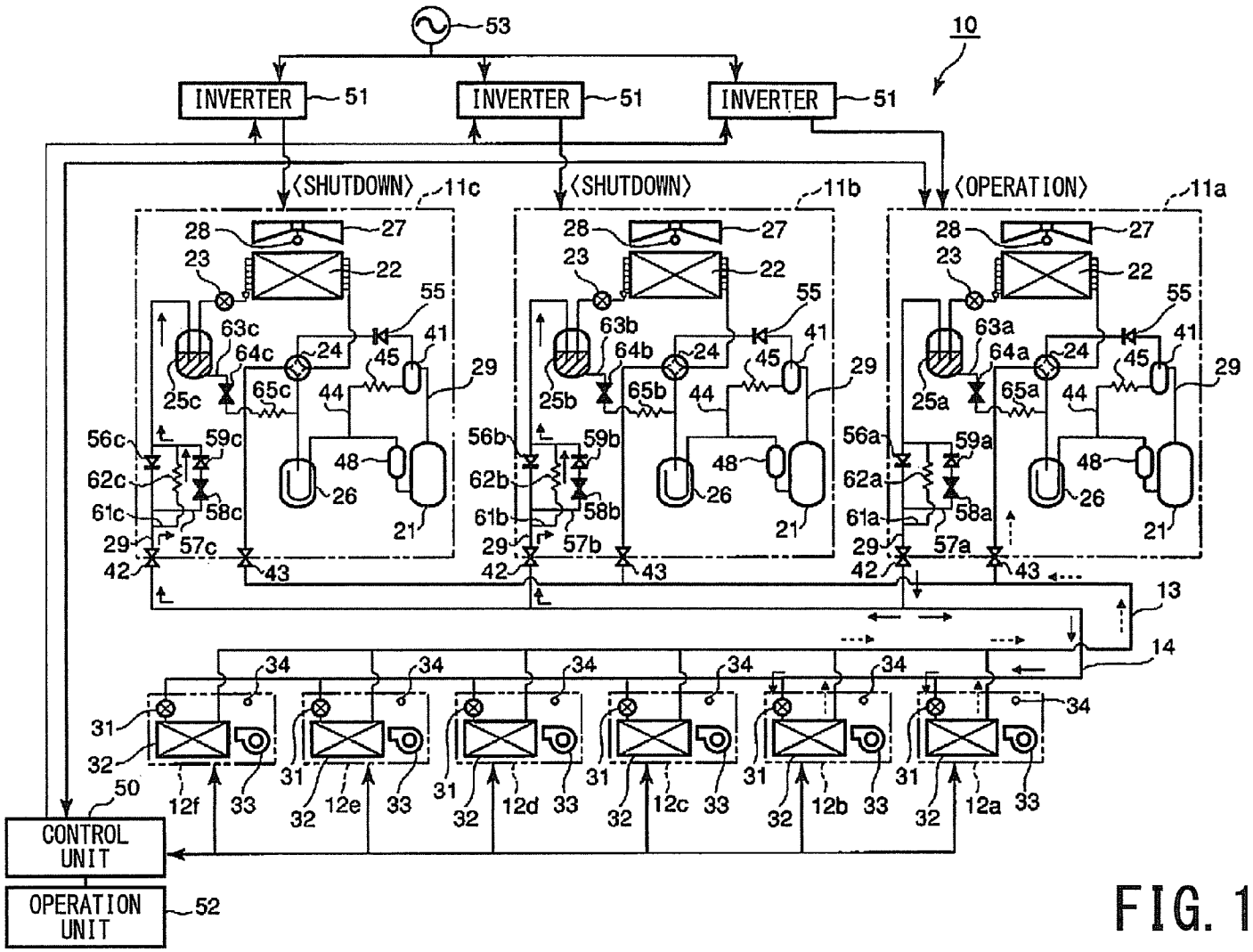
FIG. 1 is a schematic diagram showing a configuration of an embodiment of the multi-type air conditioner according to the present invention.
Figure 2:
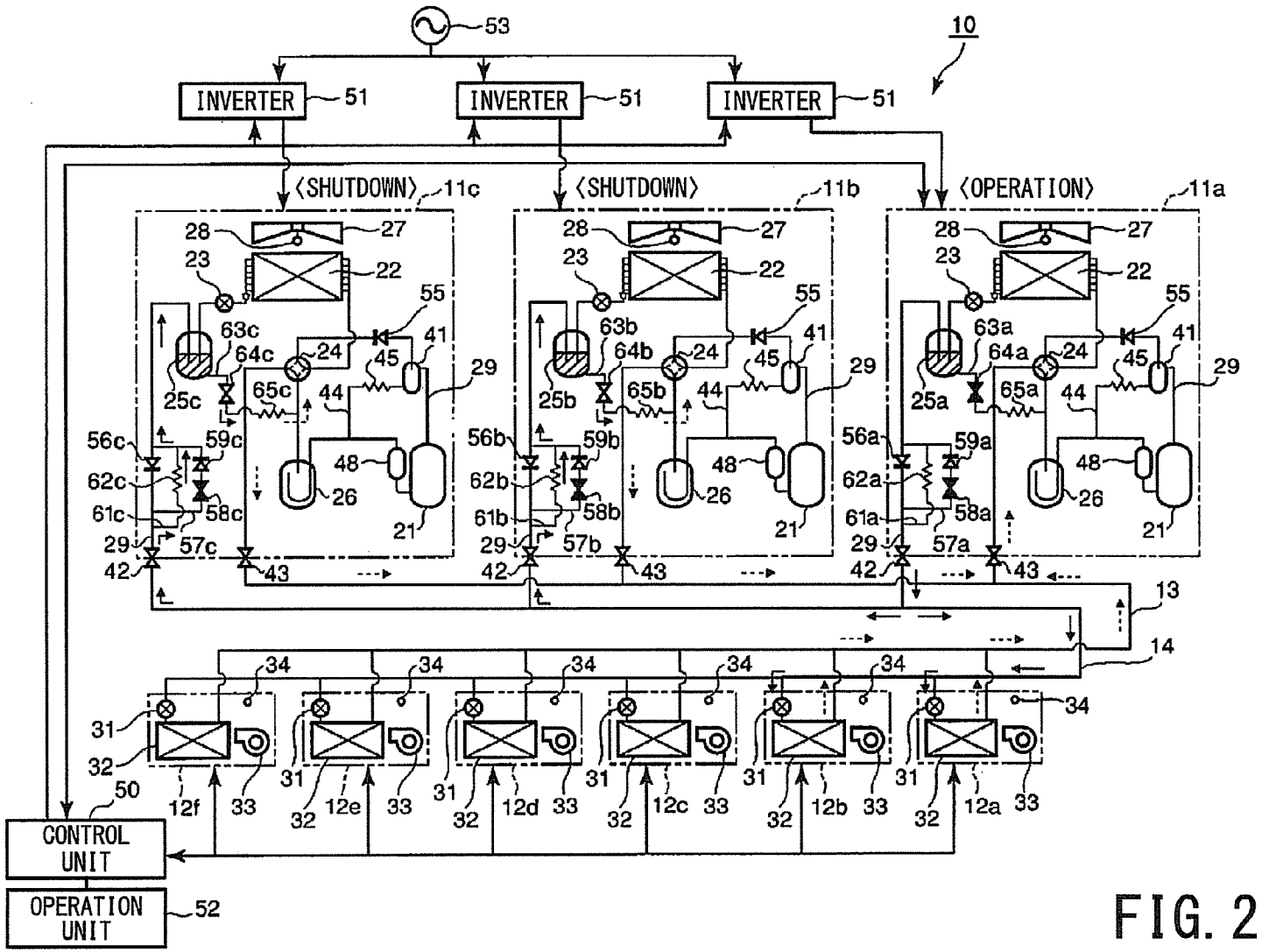
FIG. 2 is a schematic diagram illustrating a condition under control performed in the present embodiment shown in FIG. 1.
Figure 3A:
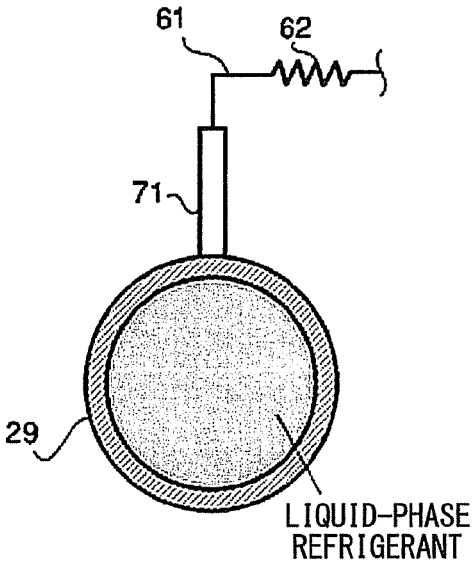
FIG. 3 includes (A) and (B) showing a connection between a first bypass circuit and a refrigerant pipe in the present embodiment.

In FIGS. 1 to 3, an air conditioner 10 according to the present embodiment is a multi-type air conditioner including a plurality of outdoor units 11 (11*a* to 11*c*) and a plurality of indoor units 12 (12*a* to 12*f*). The plurality of indoor units 12 and the plurality of outdoor units 11 are connected in parallel via a gas pipe 13 and a liquid pipe 14 which serve as a refrigerant pipe. In the present embodiment, a case where three outdoor units 11 and six indoor units 12 are provided is described as one example. However, the embodiment of the present invention is not limited thereto, and the number of outdoor units 11 may be optional as long as it is two or more.

Each of a plurality of outdoor units 11 (11*a* to 11*c*) includes a hermetic rotary compressor 21, an outdoor heat exchanger 22, an outdoor expansion valve 23, a four-way valve 24, a liquid tank 25, and an accumulator 26. These components are driven by an inverter 51 and are connected via a refrigerant pipe 29.

Each of a plurality of indoor units 12 (12*a* to 12*f*) includes an indoor expansion valve 31 and an indoor heat exchanger 32, which are connected via the refrigerant pipe 29.

In each of the outdoor units 11, a refrigerant discharge port of the compressor 21 is connected to the four-way valve 24 via the refrigerant pipe 29, and the four-way valve 24 is connected to the outdoor heat exchanger 22. For the outdoor heat exchanger 22, an outdoor fan 27 is provided for supplying outside air, and a fan motor 28 is provided for driving the outdoor fan 27.

An oil separator 41 and a check valve 55 serving as backflow prevention means are provided between a discharge side of the compressor 21 and the four-way valve 24. One end of an oil return pipe 44 is connected to the refrigerant pipe 29 between the accumulator 26 and the compressor 21, while the other end thereof is connected to an oil separator 41 via a capillary tube 45.

The outdoor heat exchanger 22 is connected to the liquid tank 25 for adjusting the refrigerant amount via the outdoor expansion valve 23, and the liquid tank 25 is connected to a liquid-side seal valve 42 used as a liquid refrigerant inlet/outlet port in the outdoor unit 11. A check valve 56 is provided between the liquid tank 25 and the liquid-side seal valve 42 to prevent the refrigerant from circulating from the liquid-side seal valve 42 to the liquid tank 25 side.

In the refrigerant pipe 29 between the liquid tank 25 and the liquid-side seal valve 42, a refrigerant cutoff circuit 57 is provided in parallel to the check valve 56. The refrigerant cutoff circuit 57 includes a shutoff valve 58 and a check valve 59. The shutoff valve 58 is opened and closed in response to the controlling by the control unit 50. When each of the outdoor units 11 is in heating operation, the shutoff valve 58 is opened, whereas when each of the outdoor units 11 is shut down or in cooling operation, the shutoff valve 58 is closed. The check valve 59 of the refrigerant cutoff circuit 57 prevents the refrigerant from flowing from the liquid tank 25 side to the liquid-side seal valve 42.

A first bypass circuit 61 including the capillary tube 62 is provided to bypass the check valve 56 and the refrigerant cutoff circuit 57. The first bypass circuit 61 is configured so that one end the refrigerant pipe 29 is connected to a position closer to the liquid-side seal valve 42 side than the check valve 56 and the refrigerant cutoff circuit 57, while the other end thereof is connected to between the check valve 56 and the check valve 59 in the refrigerant cutoff circuit 57.

As illustrated in FIG. 3, a joint portion of the first bypass circuit 61 on the liquid-side seal valve 42 side has a standing portion 71 extending upward in a gravity direction from an upper portion of the refrigerant pipe 29.

One end of the liquid pipe 14 is connected to the liquid-side seal valve 42 in each of the outdoor units 11, while the other end of the liquid pipe 14 is connected to a liquid pipe joint portion, not shown, in each of the indoor units 12.

In each of the indoor units 12, the liquid pipe joint portion is connected to the indoor expansion valve 31, which is connected to the indoor heat exchanger 32. An indoor fan 33 for indoor air circulation is provided so as to face the indoor heat exchanger 32. A room air temperature sensor 34 is provided for detecting temperature Ta of the indoor air sucked by the indoor fan 33.

One end of the gas pipe 13 is connected to each of the indoor heat exchangers 32 via a gas pipe joint portion, not shown, while the other end of the gas pipe 13 is connected to a gas-side seal valve 43 used as a gas refrigerant inlet/outlet port in each of the outdoor units 11.

The gas pipe joint portion in each of the outdoor units 11 is connected to the suction cup 48 of the compressor 21 via the four-way valve 24 and the accumulator 26.

A second bypass circuit 63 is connected to a portion between a bottom portion of the liquid tank 25 and an inlet side of the accumulator 26 in each of the outdoor units 11. The second bypass circuit 63 includes an electromagnetic valve 64 and a capillary tube 65. The electromagnetic valve 64 is opened and closed in response to control by the control unit 50, and has a function of controlling the refrigerant amount in the liquid tank 25 in accordance with the opening/closing degree of the electromagnetic valve 64.

The control unit 50 is connected to each of the four-way valves 24, each of the outside air temperature sensors 28, each of the room air temperature sensors 34, each of the inverters 51, an operation unit 52, each of the outdoor expansion valves 23, each of the indoor expansion valves 31, each of the shutoff valves 58, and each of the electromagnetic valves 64. The control unit 50 is configured to achieve a function of controlling each unit depending on various settings of the connected operation unit 52 and detection results from each sensor and the like. For example, when the outdoor unit 11 in operation and the outdoor unit 11 during shutdown are mixedly present, the control unit 50 controls so as to close the shutoff valve 58 in the outdoor unit 11 during the shutdown or to open and close the electromagnetic valve 64 of the second bypass circuit 63 based on an aperture of the indoor expansion valve 31.

The inverter 51 rectifies a voltage of a commercial AC (alternate current) power source 53, converts the rectified DV (direct current) voltage to an AC voltage of a frequency corresponding to a command from the control unit 50, and outputs the converted voltage. This output is used as driving power of the compressor 21.

The operation unit 52 connected to the control unit 50 is provided for setting various operating conditions such as an operation mode and indoor preset temperature.

In the configuration mentioned hereinbefore, a heat pump refrigeration cycle capable of performing cooling and heating operation is formed from the plurality of outdoor unit 11 to the plurality of indoor unit 12.

The function of the multi-type air conditioner 10 of the present embodiment based on the configuration mentioned above will be explained hereunder.

First, during the cooling operation, the refrigerant discharged from the compressor 21 in each of the outdoor units 11 flows through the oil separator 41, the check valve 55, the four-way valve 24, the outdoor heat exchanger 22, the outdoor expansion valve 23, the liquid tank 25, the check valve 56, and the liquid-side seal valve 42. The refrigerant then flows through a liquid-side joint portion, the indoor expansion valve 31, the indoor heat exchanger 32, and a gas-side joint portion in each of the outdoor units 12 via the liquid pipe 14. The refrigerant thereafter flows through the gas-side seal valve 43, the four-way valve 24, the accumulator 26, and the suction cup 48 in each of the outdoor units 11 via the gas pipe 13, before being sucked into the compressor 21. In this case, the outdoor heat exchanger 22 operates as a condenser and each of the indoor heat exchangers 32 operates as an evaporator.

On the other hand, during the heating operation, the refrigerant discharged from the compressor 21 in each of the outdoor units 11 circulates through the oil separator 41, the check valve 55, the four-way valve 24, and the gas-side seal valve 43. The refrigerant then circulates through the gas-side joint portion, the indoor heat exchanger 32, the indoor expansion valve 23, and the liquid-side joint portion in each of the indoor units 12 via the gas pipe 13. The refrigerant thereafter circulates through the liquid-side seal valve 42, the shutoff valve 58, the check valve 59, the liquid tank 25, the outdoor expansion valve 23, the outdoor heat exchanger 22, the four-way valve 24, the accumulator 26, and the suction cup 48 in each of the outdoor units 11 via the liquid pipe 14, before being sucked into the compressor 21. In this case, each of the indoor heat exchangers 32 operates as a condenser while the outdoor heat exchanger 22 operates as an evaporator.

In the air conditioner 10 mentioned above, the number of the plurality of outdoor units 11 to be operated is controlled in response to a demand of the indoor unit 12 side, so that the outdoor units 11 now in operation and during shutdown may mixedly exist. Herein, there is described one example of a case in which two left-hand side outdoor units 11*b* and 11*c* among three outdoor units 11 (11*a* to 11*c*) are shut down, while the right-hand side outdoor unit 11*a* is in operation, and on the other hand, in which, as to the plurality of indoor units 12, four left-hand side indoor units 12*c* to 12*f* among six indoor units are shut down, while two right-hand side indoor units 12*a* and 12*b* are in operation.

In FIGS. 1 and 2, a broken line arrow indicates the flow of the refrigerant in the gas pipe 13, and a solid line arrow indicates the flow of the refrigerant in the liquid pipe 14. In FIGS. 1 and 2, the shutoff valve 58 and the electromagnetic valve 64 painted in black are in a closed state, and those not painted in black are in an opened state.

For example, in the cooling operation, when the liquid refrigerant flows into the indoor units 12*a* and 12*b* from the outdoor unit 11*a* via the liquid pipe 14, the liquid refrigerant turns into a gas refrigerant in the indoor unit 12, and then returns to the outdoor unit 11*a* in operation via the gas pipe 13. In this operation, a part of the liquid refrigerant flowing out to the liquid pipe 14 from the outdoor unit 11*a* now in operation may flow into the outdoor unit 11*b* and 11*c* during shut down via the liquid pipe 14, and the refrigerant may be accumulated in the liquid tanks 25*b* and 25*c*. As a result, this may cause a shortage in the amount of refrigerant circulation in a refrigeration cycle excluding the shut-down outdoor units 11*b* and 11*c*. In order to prevent accumulation of the refrigerant in the outdoor units 11*b* and 11*c* during shutdown, the control unit 50 operates so as to close the shutoff valves 58*b* and 58*c* of the outdoor units 11*b* and 11*c* during shutdown.

When sufficient refrigerant is present in the refrigeration cycle excluding the outdoor units 11*b* and 11*c* now during shutdown, that is, when the amount of refrigerant circulation is sufficient, the liquid refrigerant flows into each of the refrigerant pipes 29 between each of the liquid-side seal valves 42 and the check valves 56*b* and 56*c* in the outdoor units 11*c* and 11 *b* during shutdown via the liquid pipe 14. Accordingly, as illustrated in a FIG. 3(A), the refrigerant pipe 29 is filled with the refrigerant in a liquid phase.

Since the joint portion of the first bypass circuit 61 on the liquid-side seal valve 42 side has the standing portion 71 extending upward in the gravity direction from the upper portion of the refrigerant pipe 29, the liquid refrigerant in each refrigerant pipe 29 naturally flows to the liquid tanks 25*b* and 25*c* as a surplus refrigerant via the first bypass circuits 61*b* and 61*c* of the outdoor units 11*b* and 11*c* during shutdown. The first bypass circuit 61 includes the capillary tube 62, which prevents an instantaneous inflow of a large amount of liquid refrigerant into the liquid tanks 25*b* and 25*c* of the outdoor units 11*b* and 11*c* during shutdown.

Figure 3B:
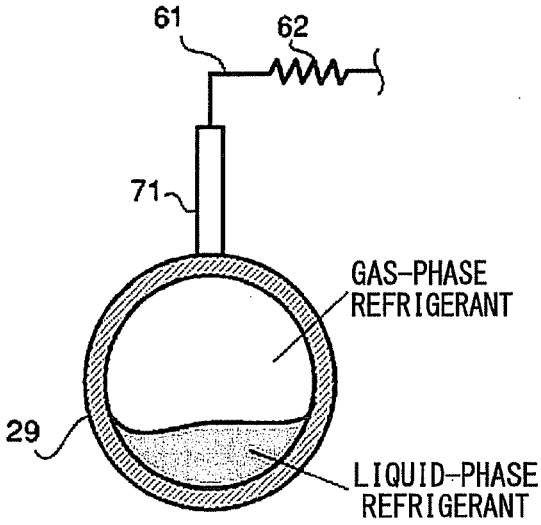

When the amount of refrigerant circulating in the refrigeration cycle excluding the outdoor units 11*b* and 11*c* now during shutdown is not sufficient, a gas-phase refrigerant is increased in the refrigerant pipe 29 between each of the liquid-side seal valves 42 and the check valves 56*b* and 56*c* in the outdoor units 11*c* and 11*b* during shutdown as illustrated in FIG. 3(B). In this case, the refrigerant is in the state of two phases including a liquid phase and a gas-phase inside the refrigerant pipe 29. Since the liquid refrigerant is heavier than the gas refrigerant, the liquid refrigerant is separated downward in the gravity direction, and on the other hand, since the gas refrigerant is lighter than the liquid refrigerant, the gas refrigerant is separated upward in the gravity direction. As described hereinbefore, since the joint portion of the first bypass circuit 61 on the liquid-side seal valve 42 side has the standing portion 71 extending upward in the gravity direction from the upper portion of the refrigerant pipe 29, the gas refrigerant in each of the refrigerant pipes 29 naturally flows to the liquid tanks 25*b* and 25*c* via the first bypass circuits 61*b* and 61*c* in the outdoor units 11*b* and 11 *c* during shutdown, thereby preventing excessive accumulation of the refrigerant in the liquid tank 25*b* and 25*c*.

In this way, the first bypass circuit 61 is provided so as to extend upward in the gravity direction above the refrigerant pipe 29. Accordingly, when the refrigerant pipe 29 is filled with the liquid-phase refrigerant, the liquid refrigerant circulates the first bypass circuit 61 and is accumulated in the liquid tank 25. When the refrigerant pipe 29 is not filled with the refrigerant of the liquid phase, the gas refrigerant circulates the first bypass circuit 61, and, hence, the refrigerant is not accumulated with large amount in the liquid tank 25, thereby properly adjusting the amount of refrigerant circulation in the refrigeration cycle excluding the outdoor units 11*b* and 11*c* during shutdown.

Furthermore, in the air conditioner 10 of the present embodiment, when there occurs shortage in the amount of refrigerant circulation in the refrigeration cycle excluding the outdoor units 11*b* and 11*c* during shutdown and such shortage is detected after the shutoff valves 58*b* and 58*c* of the outdoor units 11*b* and 11*c* during shutdown are closed, the electromagnetic valves 64*b* and 64*c* of the second bypass circuits 63 in the outdoor units 11*b* and 11*c* are opened.

Specifically, when the amount of the refrigerant circulation becomes short and the liquid pipe 14 starts to get dry for example, an opening degree of the indoor expansion valve 31 in the indoor unit 12 in operation become larger than a fixed opening. This degree of opening of the indoor expansion valve 31 is detected, and the electromagnetic valves 64*b* and 64*c* of the second bypass circuits 63*b* and 63*c* in the shut-down outdoor units 11*b* and 11*c* are controlled to be opened in accordance with the detected result. Otherwise, the electromagnetic valves 64*b* and 64*c* of the second bypass circuits 63*b* and 63*c* may be controlled to be opened periodically during the shutdown time of the outdoor units 11*b* and 11*c* which have been shut down.

As illustrated in FIG. 2, when the electromagnetic valves 64*b* and 64*c* of the second bypass circuits 63*b* and 63*c* in the outdoor units 11*b* and 11*c* during shutdown are opened, the liquid tanks 25*b* and 25*c* and inlet sides of the accumulators 26 communicate respectively with each other.

In this case, the liquid tanks 25*b* and 25*c* connected to one end of the second bypass circuits 63*b* and 63*c* communicate with a high-pressure side of the outdoor unit 11*a* now in operation via the first bypass circuits 61*b* and 61*c* and the liquid pipe 14. Meanwhile, the inlet side of each accumulator 26 connected to the other end of each of the second bypass circuits 63*b* and 63*c* communicates with a low-pressure side of the outdoor unit 11*a* now in operation via the gas pipe 13. In short, in the second bypass circuit 63, the liquid tank 25 side is in high pressure, and the inlet side of the accumulator 26 is in low pressure. Therefore, the refrigerant in the liquid tanks 25*b* and 25*c* flows into the second bypass circuits 63*b* and 63*c* and then flows out to the inlet sides of the accumulators 26.

The refrigerant which flowed out to the inlet side of each accumulator 26 flows into each refrigerant pipe 29 that connects each accumulator 26 and each four-way valve 24, flows into the gas pipe 13 via each four way valve 24 and each gas-side seal valve 43, and flows into the outdoor unit 11*a* now in operation from the gas pipe 13.

According to the operations mentioned above, the electromagnetic valves 64*b* and 64*c* of the second bypass circuits 63 in the outdoor units 11*b* and 11*c* during shutdown are opened. As a result, the shortage in the refrigerant in the refrigeration cycle excluding the outdoor units 11*b* and 11*c* during shutdown is eliminated.

According to the outdoor unit 11 of the air conditioner 10 in the present embodiment, the following advantageous effects will be obtained.

That is, even when the shutoff valves 58*b* and 58*c* of the outdoor units 11*b* and 11*c* during shutdown are closed, the refrigerant naturally flows into the liquid tanks 25*b* and 25*c* via the first bypass circuits 61*b* and 61*c* as necessary. Accordingly, it becomes possible to eliminate the necessity of performing complicated control to open and close the shutoff valves 58*b* and 58*c* for adjusting the amount of accumulation of the refrigerant in the liquid tanks 25*b* and 25*c*. It also becomes possible to prevent the shortage in the amount of refrigerant circulation in the refrigeration cycle since the refrigerant does not unnecessarily stay in the liquid tanks 25*b* and 25*c* of the outdoor units 11*b* and 11*c* during shutdown.

Furthermore, when the shortage in the amount of refrigerant circulation in the refrigeration cycle excluding the outdoor units 11*b* and 11*c* during shutdown is detected after closing the shutoff valves 58*b* and 58*c* of the outdoor units 11*b* and 11*c* during shutdown, the electromagnetic valves 64*b* and 64*c* of the second bypass circuits 63*b* and 63*c* in the outdoor units 11*b* and 11*c* during shutdown are opened, so that the refrigerant accumulated in the liquid tanks 25*b* and 25*c* in the outdoor units 11*b* and 11 *c* during shutdown flows to the outdoor unit 11*a* now in operation via the second bypass circuits 63*b* and 63*c* and the gas pipe 13, thereby eliminating the shortage of the refrigerant in the refrigeration cycle.

Still furthermore, even when the refrigerant stays in the liquid tanks 25*b* and 25*c* of the outdoor units 11*b* and 11*c* during shutdown, the stayed refrigerant can be recovered in the outdoor unit 11*a* in operation, thus reducing the refrigerant amount enclosed in the entire device.

It is to be noted that although one embodiment of the present invention has been described hereinabove, the described embodiment is merely illustrative and is not intended to restrict the scope of the embodiment. The present embodiment can be performed in other various forms, and various kinds of removals, replacements and modifications are possible without departing from the scope of the present invention. These embodiments and their modifications are intended to be embraced in the scope and sprit of the present invention, and are intended to be embraced in the invention disclosed in the scope of the claims and the equivalency thereof.

REFERENCE NUMERAL

10 - - - air conditioner, 11 - - - outdoor unit, 12 - - - indoor unit, 21 - - - compressor, 22 - - - outdoor heat exchanger, 23 - - - outdoor expansion valve, 24 - - - four-way valve, 25 - - - liquid tank, 26 - - - accumulator, 27 - - - outdoor fan, 28 - - - fan motor, 29 - - - refrigerant pipe, 31 - - - indoor expansion valve, 32 - - - indoor heat exchanger, 50 - - - control unit, 51 - - - inverter, 52 - - - operation unit, 58 - - - shutoff valve, 61 - - - first bypass circuit, 63 - - - second bypass circuit, 64 - - - electromagnetic valve

The invention claimed is:

1. A multi-type air conditioner including a plurality of indoor units and a plurality of outdoor units which are connected via refrigerant piping, each of the outdoor units comprising:

a compressor;

a four-way valve;

an outdoor heat exchanger;

an outdoor expansion valve;

a liquid tank;

an accumulator;

a shutoff valve provided for a refrigerant pipe between a liquid refrigerant inlet/outlet port and the liquid tank in each of the outdoor units; and a first bypass circuit provided in the refrigerant pipe bypassing the shutoff valve through a capillary tube to connect a liquid refrigerant inlet/outlet port side to an upper portion of the refrigerant pipe, the first bypass circuit comprising a standing portion extending upward in a gravity direction from the upper portion of the refrigerant pipe.

2. The multi-type air conditioner according to claim 1, wherein each of the outdoor units further includes a second bypass circuit connecting a bottom portion of the liquid tank to an inlet side of the accumulator via an electromagnetic valve.

* * * * *